United States Patent [19]

Wang

[11] Patent Number: 4,901,452

[45] Date of Patent: Feb. 20, 1990

[54] SHOE WITH ADAPTABLE OVERLAY

[76] Inventor: Win J. Wang, Room 3, 4 Floor, No. 309, Tun Hwa N. Rd., Taipei, Taiwan

[21] Appl. No.: 328,330

[22] Filed: Mar. 24, 1989

[51] Int. Cl.[4] ..... A43B 11/00; A43C 5/00; A43C 9/00

[52] U.S. Cl. ..... 36/50; 24/713.6; 24/712

[58] Field of Search ..... 36/50, 51; 24/140, 141, 24/143 R; 2/DIG. 6

[56] References Cited

U.S. PATENT DOCUMENTS

| | | | |
|---|---|---|---|
| 1,090,333 | 3/1914 | Nadeau | 24/140 |
| 4,282,657 | 8/1981 | Antonous | 36/50 |
| 4,394,803 | 7/1983 | Goldstein | 36/50 |
| 4,566,207 | 1/1986 | Struntz | 24/140 |
| 4,571,856 | 2/1986 | Lin et al. | 36/50 |
| 4,642,914 | 2/1987 | Cauderia | 36/50 |
| 4,811,500 | 3/1989 | Maccano | 36/50 |

FOREIGN PATENT DOCUMENTS 0122767 10/1984 European Pat. Off. ..... 36/50

*Primary Examiner*—Steven N. Meyers
*Attorney, Agent, or Firm*—Bacon & Thomas

[57] ABSTRACT

A shoe including a sole; an upper with a pair of first slits and a pair of second slits; a lace; and adhering band set having a number of pins formed on corresponding ends; a first cover element which is combinable with the shoe through the pair of first slits, the first cover element including a first strap having two first limbs with first wedge-shaped ends, a number of first eyelets for receiving the lace, a number of elongated slots which correspond to the number of pins of the adhering band set for receiving the adhering band set; and a second cover element which is combinable with the shoe through the pair of second slits, the second cover element including a second strap having two second limbs with second wedge-shaped ends, a number of second eyelets for receiving the lace, and a number of pin holes which correspond to the number of pins of the adhering band set for receiving and engaging with pins formed on the end of the adhering band set.

7 Claims, 7 Drawing Sheets

SHOE WITH ADAPTABLE OVERLAY

BACKGROUND OF THE INVENTION

The present invention relates generally to footwear, and more particularly, to a shoe of which the overlay is adaptable to different fasteners.

Conventional shoes are provided with one or several closure means to fasten the shoes. The most well-known closure means is the combination of laces and eyelets. Another type of closure means is the hook and loop (Velcro) type fastener which includes Velcro straps to adhere to each other. Examples of the Velcro type fasteners are U.S. Pat. Nos. 4,126,951, 4,308,672 and 4,296,558, all issued to Antonious. All these inventions disclose an adjustable and flexible Velcro type fastener which may or may not be used in combination with a lace type fastener. These closure assemblies, however, do not provide a wearer with the option of using different fastener assembly to secure the shoes.

U.S. Pat. No. 4,394,803 issued to Goldstein discloses a shoe overlay which is to be affixed to a blucher without eyelets. This disclosure, although being an improvement over the traditional lace type fastener, does not allow the wearer the option of using Velcro type fastener.

SUMMARY OF THE INVENTION

The primary object of the present invention is, therefore, to provide a shoe overlay which is adaptable for both Velcro type and lace type fasteners.

Another object of the present invention is to provide a shoe overlay which has interchangeable fastener means such that the wearer may choose to apply any of severals types of fasteners to the shoe as he wishes.

A further object of the present invention is to provide a shoe in which the fastener is changeable so that the body of the shoe is still usable if it is broken.

Further objects and advantages of the present invention will be observed by referring to the following description in conjunction with the accompanying drawings wherein like reference numerals refer to similar parts throughout the drawings.

DETAILED DESCRIPTION OF THE PREFERRED EMBODIMENT

Figure 1:
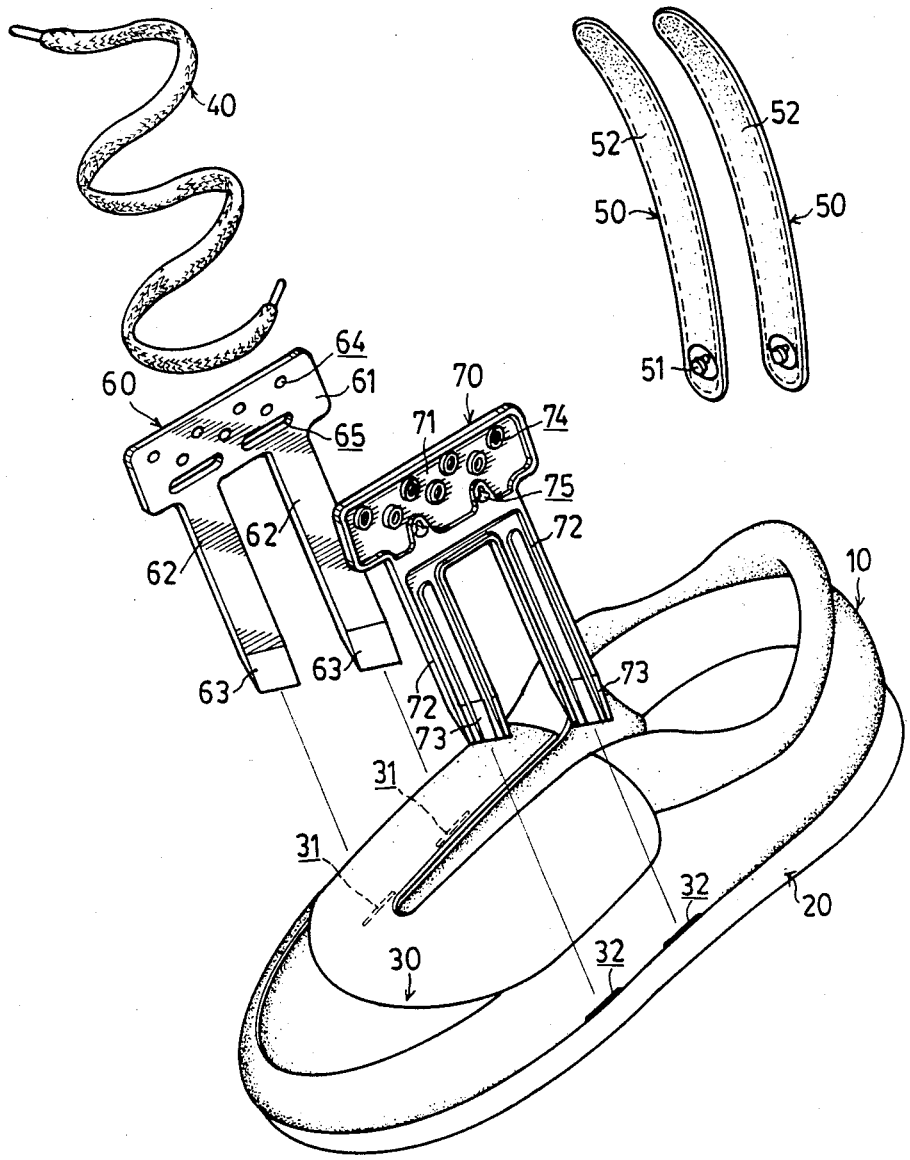
FIG. 1 is an exploded view showing a shoe in accordance with the present invention.
Figure 2:
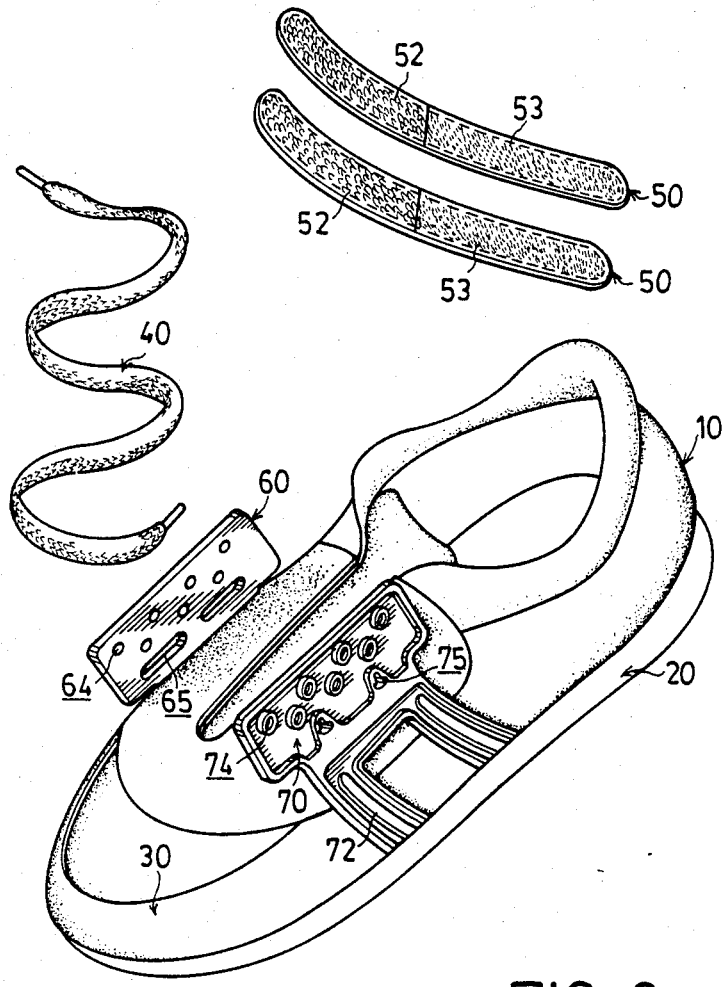
FIG. 2 is a perspective view showing the shoe of FIG. 1 with all the closure means in open position.

Referring to the drawings and initially to FIGS. 1 and 2, it can be seen that a shoe in accordance with the present invention is shown generally at 10. The shoe 10 includes a sole 20, an upper 30 having two pairs of slits 31, 32, a lace 40, an adhering band set 50, a first cover element 60 which is combined with the shoe 10 through the pair of first slits 31 (shown in dotted line, because they are blocked by the body of the shoe 10), and a second cover element 70 which is combined with the shoe 10 through the pair of second slits 32. The sole 20 is affixed to the upper 30 in a known manner. The two pairs of slits 31 and 32 are respectively formed on a first lateral side and a second lateral rim of the upper 30 and substantially parallel with the sole 20.

The first cover element 60 is, in general, a first strap 61 with two first limbs 62, extending from one longitudinal edge thereof. It is preferable that the two first limbs 62 have first wedge-shaped ends 63 such that when they are wedged into the pair of first slits 31 formed on the first lateral side of the upper 30, the connection thereof with the upper 30 is smooth. The length of the first limbs 62 is such that when the first cover element 60 is affixed to the upper 30, the first limbs 62 are inserted into the pair of first slits 31 and the first wedge-shaped ends 63 thereof are in proximity to the sole 20. Formed on the first strap 61 are a plurality of first eyelets 64 to receive the lace 40. Two elongated slots 65 are further formed on the first strap 61 to receive the adhering band set 50.

The second cover element 70 is similar to the first cover element 60, in the form of a second strap 71 with two second limbs 72 which have second wedge-shaped ends 73. The second limbs 72 are so disposed that when the second cover element 70 is affixed to the upper 30, the second wedge-shaped ends 73 of the second limbs 72 are inserted into the pair of second slits 32 so as to be in proximity to the sole 20. The second strap 71 also has a plurality of second eyelets 74 formed therethrough to receive the lace 40. A number of pin hole(s) 75 is formed along one of the longitudinal edges of the second strap 71 to receive and engage with the corresponding pin(s) 51 formed on the end of the adhering band set 50, which is preferably a Velcro type fastener. The number of pin hole(s) 75 is corresponding to the number of the pin(s) 51 of the adhering band set 50.

The adhering band set 50 consists of a number of Velcro type fastener(s). As mentioned above, the adhering band set 50 has a pin 51 on one end of each of the Velcro type fastener(s). The adhering band set 50 also has a first adhering face 52 and a second adhering face 53.

A wearer can use either the lace 40 or the adhering band set 50, i.e., the Velcro type fasteners to secure the shoe 10.

Figure 3:
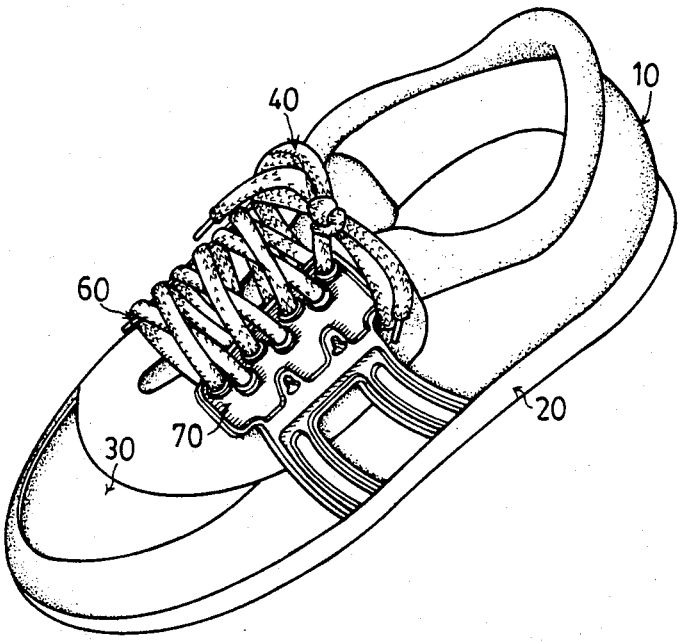
FIG. 3 is a perspective view showing the shoe of FIG. 1, showing a lace type closure means in closed position.

Referring to FIG. 3, if the lace 40 is chosen, it is inserted through the first and second eyelets 64 and 74 of both first and second cover elements 60 and 70 respectively and secured in a common manner to provide the required tautness.

Figure 4:
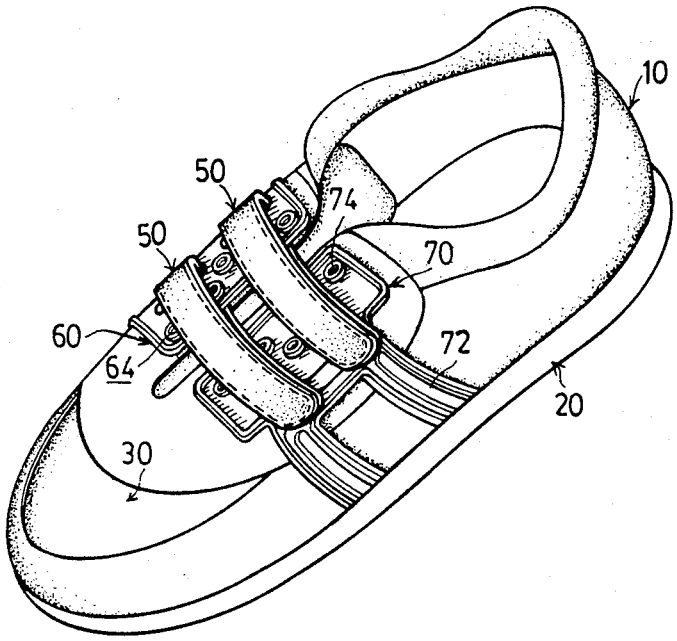
FIG. 4 is a perspective view of the shoe of FIG. 1, showing a Velcro type closure means in closed position.
Figure 5:
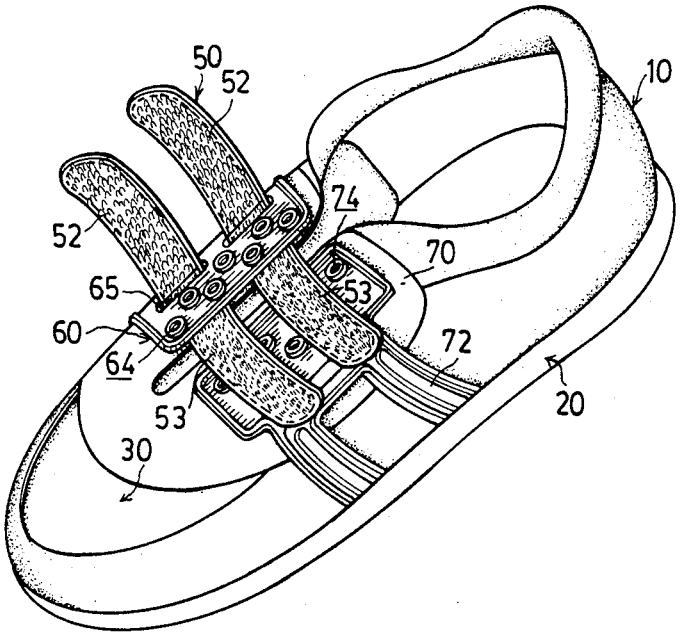
FIG. 5 is a perspective view similar to FIG. 4, in which the Velcro type closure means is in opened position.

Referring next to FIGS. 4 and 5, if instead of choosing the lace 40, the adhering band set 50 is preferable, the pin(s) 51 of the adhering band set 50 is affixed to the second cover element 70 with the pins 51 thereof engaging with the pin holes 75 formed on the second cover element 70 and the adhering band set 50 are inserted through the elongated slots 65 and folded back to adhere the first adhering face 52 to the second adhering face 53 so as to secure the shoe 10.

Figure 6:
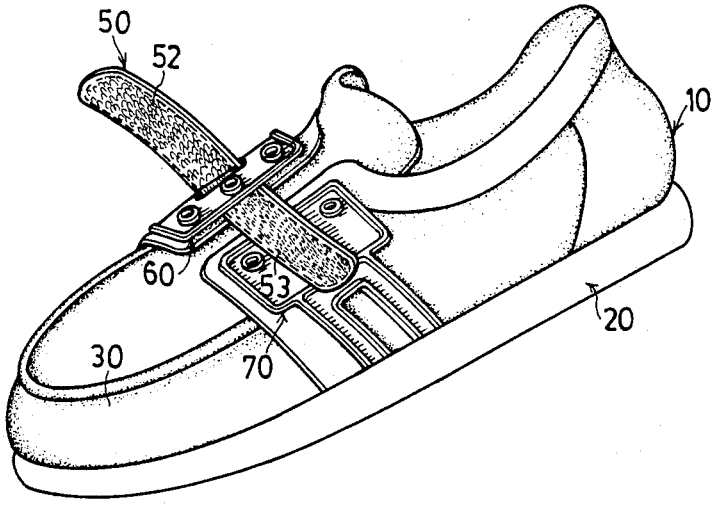
FIG. 6 is a perspective view showing another embodiment of the shoe, in which the a Velcro type closure means is in closed position.
Figure 7:
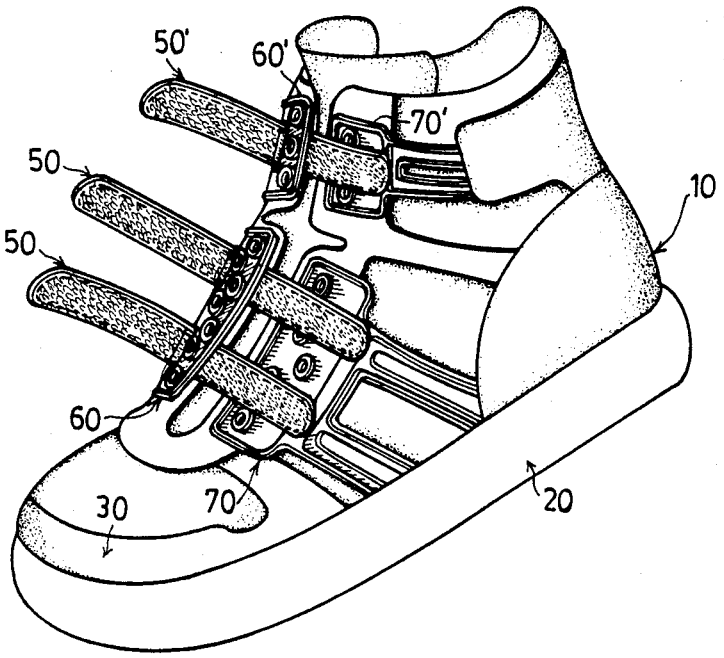
FIG. 7 is a perspective view showing yet another embodiment the shoe, in which a Velcro type closure means is in closed position.

Referring next to FIGS. 6 and 7, it can be seen that the adhering band set 50 can be constructed in a single-band form as in FIG. 6, a double-band form as in FIG. 4 or a three-band form as in FIG. 7, in a similar manner to that illustrated above. For blucher, it is preferable to use the three-band form adhering band set 50. A separate Velcro assembly band 50' as well as a first cover element 60' and a second cover element 70' are employed to secure the upper part of the shoe 10.

While the present invention has been described with respect to a preferred embodiment of the invention, it will be understood by those skilled in the art after understanding the invention, that changes and modifications may be made without departing from the spirit and the scope of the invention defined by the following claims.

I claim:

1. A shoe with an adaptable overlay comprising:

a sole;

an upper with a pair of first slits and a pair of second slits respectively formed on a first lateral side and a second lateral side thereof and substantially parallel with said sole;

a lace;

an adhering band set including at least one adhering band having a pin formed on an end thereof;

a first cover element which is combinable with the shoe through said pair of first slits, said first cover element comprising a first strap having two first limbs with first wedge-shaped ends, a plurality of first eyelets for receiving said lace, a number of elongated slots which correspond to a number of pins of said adhering band set for receiving said adhering band set; and a second cover element which is combinable with the shoe through said pair of second slits, said second cover elements comprising a second strap having two second limbs with second wedge-shaped ends, a plurality of second eyelets for receiving said lace, and a number of pin holes which correspond to the number of pins of said adhering band set, said pin holes for receiving and engaging with said pins.

2. A shoe with an adaptable overlay as claimed in claim 1, wherein said first wedge-shaped ends are respectively wedged into the pair of first slits.

3. A shoe with an adaptable overlay as claimed in claim 1, wherein a length of the first limbs is such that the first limbs are inserted into said pair of first slits and the first wedge-shaped ends thereof are in proximity to the sole when the first cover element is affixed to the upper.

4. A shoe with an adaptable overlay as claimed in claim 1, wherein said second wedge-shaped ends of the second limbs are inserted into said pair of second slits and in proximity to said sole.

5. A shoe with an adaptable overlay as claimed in claim 1, wherein said adhering band set is in single-band form.

6. A shoe with an adaptable overlay as claimed in claim 1, wherein said adhering band set is in double-band form.

7. A shoe with an adaptable overlay as claimed in claim 1, wherein said adhering band set is in three-band form.

* * * * *